US008939853B1

(12) United States Patent
Karn et al.

(10) Patent No.: US 8,939,853 B1
(45) Date of Patent: Jan. 27, 2015

(54) ARTICLE OF MANUFACTURE FOR THE TRAINING OF ATHLETES IN THE SKILLS, SHOOTING, DRIBBLING AND THROWING OF BALL SPORTS

(71) Applicants: Charles Alan Karn, Edwards, CO (US); Seth Edward Karn, Caddo, CO (US)

(72) Inventors: Charles Alan Karn, Edwards, CO (US); Seth Edward Karn, Caddo, CO (US)

( * ) Notice: Subject to any disclaimer, the term of this patent is extended or adjusted under 35 U.S.C. 154(b) by 0 days.

(21) Appl. No.: 13/986,419

(22) Filed: Apr. 30, 2013

(51) Int. Cl.
*A63B 69/00* (2006.01)

(52) U.S. Cl.
CPC ..... *A63B 69/0071* (2013.01)
USPC ..... 473/450; 422/422; 422/447

(58) Field of Classification Search
CPC ..... A63B 69/0059; A63B 69/0002; A63B 69/38; A63B 69/36; A63B 69/0071; A63B 2069/0008; A63B 2069/0006
USPC ..... 473/422, 450, 458, 464, 214, 212; 2/16, 2/59; 602/20, 62–64
See application file for complete search history.

(56) References Cited

U.S. PATENT DOCUMENTS

| | | | | |
|---|---|---|---|---|
| 2,211,203 | A * | 8/1940 | Goldman | 128/881 |
| 2,704,063 | A * | 3/1955 | Young | 16/361 |
| 4,605,227 | A * | 8/1986 | Hurd et al. | 473/63 |
| 4,763,901 | A * | 8/1988 | Richter | 602/20 |
| 4,911,728 | A * | 3/1990 | Rigel | 473/458 |
| 5,395,117 | A * | 3/1995 | Ogden | 473/214 |
| 5,509,426 | A * | 4/1996 | Sowerby | 602/12 |
| 5,769,743 | A * | 6/1998 | Stephan et al. | 473/450 |
| 2009/0253527 | A1* | 10/2009 | Abraham | 473/214 |
| 2010/0190564 | A1* | 7/2010 | Lindby | 473/214 |

* cited by examiner

*Primary Examiner* — Mitra Aryanpour

(57) ABSTRACT

An article of manufacture for the training of athletes in the skills, shooting, dribbling and throwing of ball sports with an elastic material in the form of a pull-up sleeve, a sleeve that is pulled up and worn above and below the elbow with the restraining tubes on the top and bottom of the inside of the elbow joint, a sleeve that has 2 (two) flexible, semi-rigid restraining tubes above and below the elbow, the restraining mechanism will only allow the elbow joint to close to 90 degrees, a sleeve that remains in place during extensive use with the sleeve construction of and in elastic or stretchable material and foams, and the sleeve can be turned to the back of the elbow to protect the elbow joint.

3 Claims, 2 Drawing Sheets

ARTICLE OF MANUFACTURE FOR THE TRAINING OF ATHLETES IN THE SKILLS, SHOOTING, DRIBBLING AND THROWING OF BALL SPORTS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sports and more specifically to an article of manufacture for the training of athletes in the skills, shooting, dribbling and throwing of ball sports.

The difficulty in training athletes to utilize the proper 90 degree angle of the elbow in dribbling, shooting and throwing is evident in the observation of athletes in all ball handling sports. During athletic skill practices the emphasis on the elbows 90 degree angle is important in shooting, throwing and dribbling, however athletes find it difficult to maintain the proper elbow angle during skills development. To provide the necessary resistance for muscle memory the manufactured device was created.

Previous devices were created that had strap or string restaints that attached to the arm or the body to provide a measure of resistance or stop for the proper angle of the elbow. The devices could only be utilized in a limited practice or play environment and needed to be removed to allow the athlete to continue in other drills or practice. These devices could only be utilized in a limited practice or play environment and needed to be removed to allow the athlete to continue in other drills or practice. The devices were cumbersome and relayed heavily on there use in static drills only.

BRIEF SUMMARY OF THE INVENTION

The primary object of the invention is an elastic sleeve that trains athletes in the proper elbow angle for throwing, dribbling, and shooting in ball handling sports.

Another object of the invention is an elastic sleeve that restricts the elbow to the appropriate 90 degree angle.

Another object of the invention is a sleeve that is constructed to remain in place throughout extensive training and practice sessions.

A further object of the invention is a sleeve that can be worn comfortably during practice and removed during games.

Yet another object of the invention is a sleeve that can provide elbow protection when not being utilized for training purposes.

Still yet another object of the invention is a sleeve that is designed for all ages.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an article of manufacture for the training of athletes in the skills, shooting, dribbling and throwing of ball sports comprising: an elastic material in the form of a pull-up sleeve, a sleeve that is pulled up and attached above and below the elbow with the restraining tubes on the top and bottom of the inside of the elbow joint, a sleeve that has 2 (two) flexible, semi-rigid restraining tubes above and below the elbow, the restraining mechanism will only allow the elbow joint to close to 90 degrees, a sleeve that remains in place during extensive use with the sleeve construction of and in elastic or stretchable material and foams, and the sleeve can be turned to the back of the elbow to protect the elbow joint.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
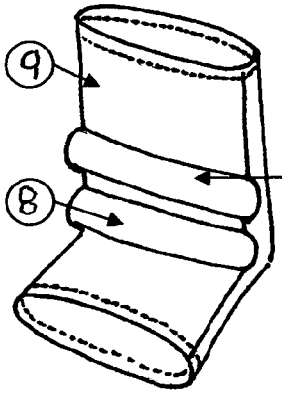
FIG. 1 is a front perspective view of the invention.
Figure 4:
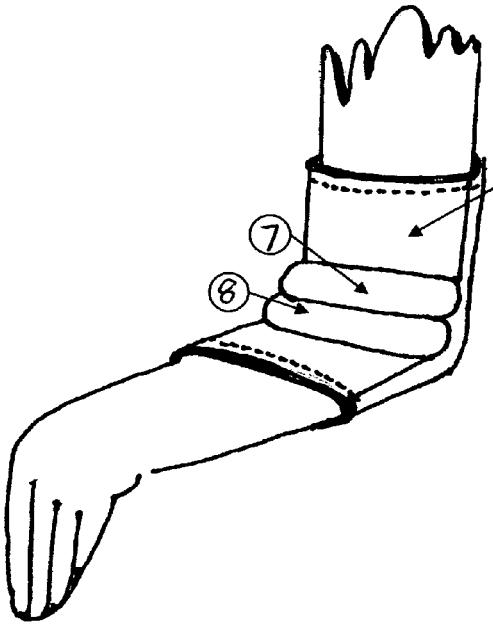
FIG. 4 is a side perspective of the invention on the arm thereof.

In accordance with the present invention, FIG. 1 details the basic structure of the invention. To accomplish the important function of the invention, there is shown in FIG. 1 the elastic material manufactured in the form of a pull-up, arm sleeve 9;

The elastic sleeve 9, depicted in FIG. 1 displays the attachment or insertion into or on the sleeve of 2 (two) flexible, semi-rigid, restraining attachments or insertions 7,8;

To accomplish an important function of the invention, there is shown in FIG. 1 and FIG. 4 the limitation of movement in the elbow joint to 90 degrees as the attachment or insertions 7,8 are compressed against each other in the act of shooting, throwing or dribbling to train the athlete in the proper arm positions.

Figure 2:
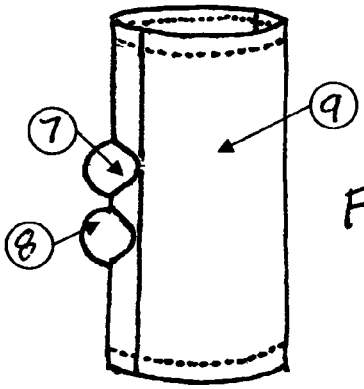
FIG. 2 is a side perspective, thereof.
Figure 3:
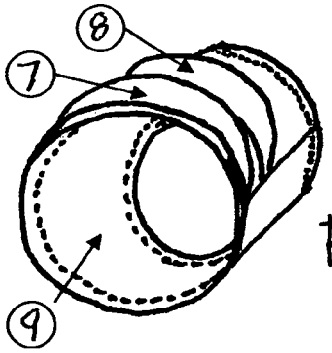
FIG. 3 is a top perspective view thereof.
Figure 5:
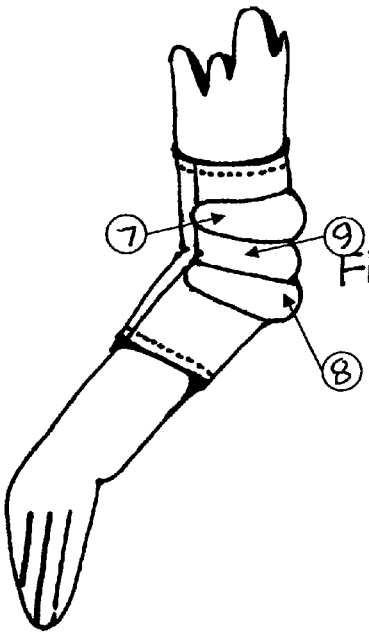
FIG. 5 is a side perspective of the invention protecting the elbow thereof.

In accordance with this important feature of the present invention, there is shown in FIG. 2 the attachment or insertion of the 2 (two) attachments or insertions with one placement above 7 and one below 8 the midline of the elastic sleeve;

A sleeve that remains in place during extensive use with the sleeve construction of and in elastic or stretchable material and foams as well as sizing and density of the attachments or insertions that are determined by the size of the athletes arm circumference;

The sleeve as depicted in FIG. 5 may also be utilized for elbow protection when turned 180 degrees and positioning the tube 7 above the elbow joint on the back of the arm and positioning tube 8, below the elbow joint;

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A training sleeve to be worn on an arm of an athlete for aiding the athlete to improve the athlete's ability to shoot, dribble and throw a sports ball, the sleeve comprising:

a tubular member, said tubular member including a front side, a back side, an upper end and a lower end;

a plurality of flexible, semi-rigid restraining tubes attached to the tubular member and extend above and below a midsection of said tubular member;

wherein when the plurality of restraining tubes are positioned the bend of the athlete's arm, the plurality of restraining tubes will allow the athlete's elbow to bend no more than 90 degrees; and wherein when the plurality of restraining tubes are positioned over the athlete's elbow, the plurality of restraining tubes cover and protect the athlete's elbow from injury.

2. The training sleeve of claim 1, wherein the tubular member is formed from material consisting of elastic material, stretchable material and foams.

3. The training sleeve of claim 1, wherein said plurality of restraining tubes are removably attached on an outer surface of the tubular member or in an inner surface of the tubular member.

* * * * *